US010882712B2

(12) United States Patent
Griffies

(10) Patent No.: US 10,882,712 B2
(45) Date of Patent: Jan. 5, 2021

(54) TAPE DISPENSER WITH OPENING FOR TAPE CONTROL

(71) Applicant: Gerald Griffies, Newnan, GA (US)

(72) Inventor: Gerald Griffies, Newnan, GA (US)

( * ) Notice: Subject to any disclaimer, the term of this patent is extended or adjusted under 35 U.S.C. 154(b) by 0 days.

(21) Appl. No.: 16/269,087

(22) Filed: Feb. 6, 2019

(65) Prior Publication Data

US 2020/0247638 A1 Aug. 6, 2020

(51) Int. Cl.
*B65H 35/00* (2006.01)
*B65H 35/06* (2006.01)

(52) U.S. Cl.
CPC ..... *B65H 35/0033* (2013.01); *B65H 35/0073* (2013.01); *B65H 35/06* (2013.01)

(58) Field of Classification Search
CPC ..... B65H 37/005; B65H 35/0026; B65H 35/0033; B65H 35/0073; B65H 35/06
See application file for complete search history.

(56) References Cited

U.S. PATENT DOCUMENTS 2,718,924 A * 9/1955 Robbins ..... B65H 35/0033 225/66
2,790,609 A * 4/1957 Hawthorne ..... B65H 35/0026 206/403
5,358,113 A * 10/1994 Hellenbrand ..... B65D 83/0864 206/409
5,468,332 A * 11/1995 Dretzka ..... B65H 35/0026 156/527
5,538,170 A * 7/1996 Van Luit ..... B65H 35/002 225/47
2016/0207729 A1* 7/2016 Chandaria ..... B65H 35/0026
2019/0092597 A1* 3/2019 Carrion ..... B65H 35/0033

* cited by examiner

*Primary Examiner* — Alex B Efta

(57) ABSTRACT

Methods and devices for dispensing tape are disclosed. An example device may comprise a tape guide portion. The device may comprise a pair of side walls extending longitudinally rearward from the tape guide portion. The device may comprise a bar that at least partially extends from one of the pair of side walls towards the other of the pair of side walls. The device may comprise an aperture disposed through the tape guide portion to define a through hole from a top side to a bottom side of the tape guide portion for receiving a finger of a user to press tape extending from a tape roll against the bar to releasably affix the tape to allow cutting the tape.

18 Claims, 6 Drawing Sheets

TAPE DISPENSER WITH OPENING FOR TAPE CONTROL

BACKGROUND

Tape provides a simple way to adhere together different surfaces. A variety of devices have been proposed to allow for efficient dispensing of tape. Some devices, such as pistol grip tape dispensers, are efficient at dispensing and cutting tape but are too expensive and bulky for a typical consumer. More lightweight and portable tape dispensers lack mechanisms for efficiency and control in dispensing tape. Thus, there is a need for more sophisticated tape dispensers.

SUMMARY

Methods and devices for dispensing tape are disclosed. An example device may comprise a tape guide portion. The device may comprise a pair of side walls extending longitudinally rearward from the tape guide portion. The device may comprise a bar that at least partially extends from one of the pair of side walls towards the other of the pair of side walls. The device may comprise an aperture disposed through the tape guide portion to define a through hole from a top side to a bottom side of the tape guide portion for receiving a finger of a user to press tape extending from a tape roll against the bar to releasably affix the tape to allow cutting the tape.

Another example device may comprise a tape guide portion of a molded frame. The tape guide portion may comprise a front portion and a back portion. The back portion may extend rearward from the front portion to partially cover a tape roll. The device may comprise a cutting edge disposed adjacent the front portion and spaced from the tape roll for cutting at least a portion of the tape roll. The device may comprise a pair of side walls extending longitudinally rearward from the tape guide portion. The device may comprise a pair of hubs for supporting the tape roll. Each of the pair of hubs may transversely extend inwardly from a corresponding side wall of the pair of side walls. The device may comprise a bar that at least partially extends from one of the pair of side walls towards the other of the pair of side walls. The device may comprise an aperture disposed through the tape guide portion to define a through hole from a top side to a bottom side of the tape guide portion suitable for receiving a finger of a user to press tape extending from the tape roll against the bar to releasably affix the tape to allow cutting the tape against the cutting edge.

An example method may comprise inserting a tape roll into a molded frame comprising a tape guide portion, a pair of side walls extending longitudinally rearward from the tape guide portion, a bar that at least partially extends from one of the pair of side walls towards the other of the pair of side walls, and an aperture disposed through the tape guide portion to define a through hole from a top side to a bottom side of the tape guide portion. The method may comprise pulling tape from the tape roll. The method may comprise preventing unrolling of the tape roll by forcing, via the aperture, at least a portion of the tape against the bar. The method may comprise cutting an end of the tape from the tape roll while the tape roll is prevented from unrolling.

Additional advantages will be set forth in part in the description which follows or may be learned by practice. It is to be understood that both the foregoing general description and the following detailed description are exemplary and explanatory only and are not restrictive.

BRIEF DESCRIPTION OF THE DRAWINGS

The accompanying drawings, which are incorporated in and constitute a part of this specification, illustrate embodiments and together with the description, serve to explain the principles of the methods and systems.

DETAILED DESCRIPTION OF ILLUSTRATIVE EMBODIMENTS

The present disclosure relates to methods and devices for dispensing tape. The device may be a hand-held tape dispenser that is lightweight and portable. The device may be an injection molded tape dispenser that has flexible side walls for receiving and supporting a tape roll, such as tape roll for packing tape, mailing tape, and/or the like. The device may be suitable for commercial and non-commercial use. The device may be used in a commercial packaging facility, at a user's home, or any other location. The device has the advantage over conventional devices of including an aperture (e.g., opening, recess, notch, indentation) in a top side of the device that allows a user to better manage the tape extending from a tape roll. While some conventional devices may have openings on the top side of the dispenser, these openings are not suitable for allowing a user to control dispensing of the tap. Conventional openings may be too small, poorly positioned, and/or otherwise not designed for receiving the finger of a user to control the tape. A conventional opening, for example, may include a hole for hanging a tape dispenser. Such hole is too small for receiving a finger of a user. The disclosed device also may have a bar that is disposed for pressing the tape against the bar to allow more control of the tape during cutting of the tape. The user may insert a finger via the aperture and press the tape to the bar while cutting the tape against a cutting edge of the device. While conventional tape dispensers may have tabs that prevent unrolled tape from returning to the tape roll, these tabs are too small to allow a user to press the tape in place while cutting. Conventional tabs also are not designed to be engaged with the tape while the user is cutting. As described further herein, the disclosed device may include the aperture and/or bar to allow for a more user friendly experience.

Figure 1:
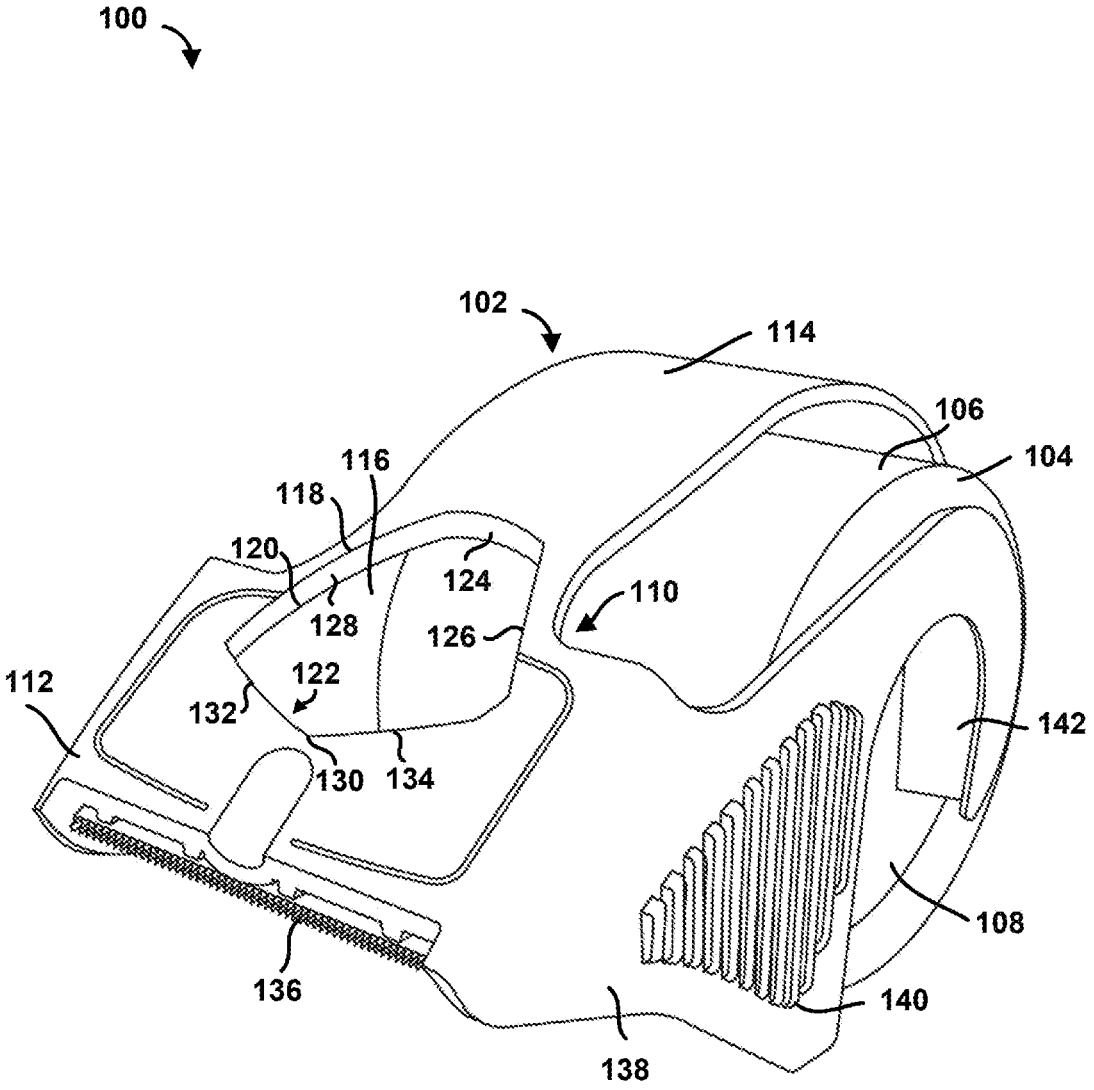
FIG. 1 is a front perspective view of an example device for dispensing tape.

FIG. 1 is a front perspective view of an example device 100 for dispensing tape. The device 100 may comprise a frame 102 (e.g., or body). The frame 102 may comprise a molded frame, such as an injection molded frame. The frame 102 may comprise a flexible material, such as a plastic material, plastic polymer, or a combination thereof. The frame 102 may support a tape roll 104. The tape roll 104 may be removable from the frame 102. The tape roll 104 may comprise tape 106 wound around a cylindrical core 108 (e.g., a cardboard cylinder). The tape 106 may comprise packaging tape, mailing tape, or the like. The tape 106 may have a width of from about two inches up to about 3.5 inches. The tape 106 may be unwound from the tape roll 104 by pulling an end of the tape 106 away from tape roll 104 (e.g., while allowing the tape roll 104 to rotate).

The device 100 (e.g., the frame 102) may comprise a tape guide portion 110. The tape guide portion 110 may be disposed to guide the tape 106 from the tape roll 104. The tape guide portion 110 may comprise a front portion 112. The front portion 112 may be disposed for receiving, cutting, and/or guiding the tape 106 from the tape roll 104. The front portion 112 may not support the tape roll 104 (e.g., may be disposed in front of the tape roll 104). The front portion 112 may be planar or substantially planar (e.g., having a degree of curvature of about 5 degrees or less). The front portion 112 may be wider than the tape roll 104.

The tape guide portion 110 may comprise a back portion 114. The back portion 114 may be disposed for at least partially covering the tape roll 104. The back portion 114 may extend longitudinally rearward from the front portion 112. The front portion 112 and the back portion 114 may be centered on a longitudinal axis. The back portion 114 may be narrower than the tape roll 104. The back portion 114 may be narrower than the front portion 112. The back portion 114 of the tape guide portion 110 may be at least partially curved inwardly. A degree of curvature of the back portion 114 may increase as the back portion 114 extends away from the front portion 112. At least a portion of the back portion 114 may have curvature that is based on (e.g., matches) a curvature of the tape roll 104.

The tape guide portion 110 may comprise an aperture 116 (e.g., opening, hole, notch, indentation, recess). The aperture 116 may be disposed through the tape guide portion 110. The aperture 116 may be disposed through the tape guide portion 110 to define a through hole from a top side 118 to a bottom side 120 of the tape guide portion 110. The aperture 116 may be disposed through one or more of the front portion 112 or the back portion 114. The aperture 116 may be disposed through both the front portion 112 and the back portion 114. A front of the aperture 116 may be disposed through the front portion 112. A back of the aperture 116 may be disposed through the back portion 114.

The aperture 116 may be at least partially shaped as a square, diamond, circle, ellipse, triangle, and/or the like. The aperture 116 may have a curvilinear shape. At least a portion (e.g., the portion towards the back portion 114) of the aperture 116 may have an ergonomic shape for receiving a finger. At least a portion of aperture 116 may taper inwardly as the aperture 116 extends from the front portion 112 to the back portion 114 of the tape guide portion 110. As an example, the aperture 116 of the finger opening through the back portion 114 may be configured to allow comfortable finger entry to access the tape roll 104 allowing the operator control of the tape. As a further example, the approximate but variable width of the opening in the back portion may be about 33 mm maximum with a narrowing to a rounded curve extending to a full length of approximately 33 mm into the back portion 114.

The aperture 116 may comprise a front side 122 towards the front portion 112. The front side 122 may be curved, angled, straight, or a combination thereof. The aperture 116 may comprise a back side 124 towards the back portion 114. The back side 124 may be curved, angled, straight, or a combination thereof. The aperture 116 may comprise a right side 126. The right side 126 may be curved, angled, straight, or a combination thereof. The aperture 116 may comprise a left side 128 opposite the right side 126. The left side 128 may be curved, angled, straight, or a combination thereof. The left side 128 may extend between the front side 122 and the back side 124. The right side 126 may extend between the front side 122 and the back side 124. The back side 124 may be curved between the left side 128 and the right side 126. The front side 122 may be angled and may include a vertex 130. A front left side 132 may extend from the vertex 130 to the left side 128 of the aperture 116. A front right side 134 may extend from the vertex 130 to the right side 126 of the aperture 116.

In some implementations, the tape guide portion 110 may have a front portion 112 without a back portion 114. The aperture 116 may comprise a recess (e.g., notch, indentation) in a back side of the front portion 112.

The device 100 (e.g., and the frame 102) may comprise a cutting edge 136. The cutting edge 136 may be disposed adjacent the front portion 112. The cutting edge 136 may be attached to the front portion 112. The cutting edge 136 may be attached to an end of front portion 112 opposite the back portion 114. The cutting edge 136 may be disposed on a bottom side 120 of the tape guide portion 110 (e.g., a bottom side of the front portion 112. The cutting edge 136 may be spaced from the tape roll 104 at an appropriate distance for cutting at least a portion of the tape roll 104. The cutting edge 136 may comprise a razor, a plurality of cutting ridges, and/or the like. The cutting edge 136 may comprise a shape, rigid material, such as a metal.

The device 100 (e.g., and the frame 102) may comprise a pair of side walls 138. The pair of side walls 138 may extend longitudinally rearward from the tape guide portion 110 (e.g., from the front portion 112). A transition from the tape guide portion 110 to the pair of side walls 138 may be curved, angled, and/or the like. The pair of side walls 138 (e.g., or the transition from the tape guide portion 110 to the pair of side walls 138) may be sufficiently flexible to allow the pair of side walls 138 to be spread apart from each other while removing or inserting the tape roll 104 between the pair of side walls 138. The pair of side walls 138 may be angled toward each other. The angle may cause pressure against the tape roll 104 to keep the tape roll 104 between the pair of side walls 138. An example angle of the pair of side walls 138 may above zero degrees and less than 10 degrees.

The pair of side walls 138 may comprise a plurality of ridges 140 on an outer surface of the pair of side walls 138. The plurality of ridges 140 may provide grip for a hand holding the device 100 by the pair of side walls 138. The plurality of ridges 140 may vary in size, length, depth, and/or the like. The plurality of ridges 140 may be patterned in a shape that at least partially matches a shape of the pair of side walls 138. The plurality of ridges 140 may be disposed parallel to each other. The plurality of ridges 140 may be separated by from each other by grooves (e.g., or empty spaces between the plurality ridges 140).

The device 100 (e.g., the pair of side walls 138) may comprise a pair of hubs 142. The pair of hubs 142 may be disposed for supporting the tape roll 104. Each of the pair of hubs 142 may transversely extend inwardly from a corresponding side wall of the pair of side walls 138. The pair of hubs 142 may engage with the cylindrical core 108 to support the tape roll 104. The pair of hubs 142 may have a curved top side (e.g., that allows for rotation of the tape roll 104). The curved top side of the pair of hubs 142 may have an arcuate shape.

Figure 2:
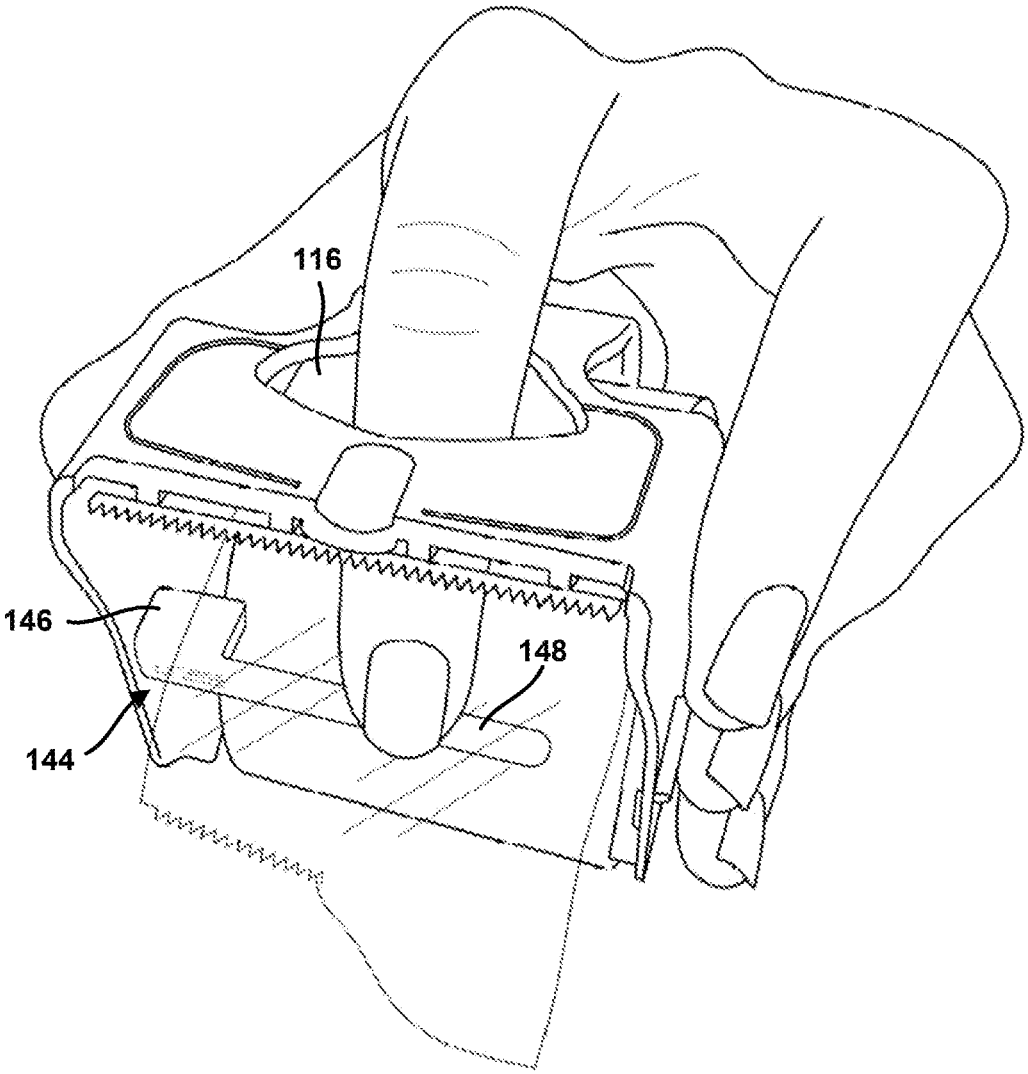
FIG. 2 is another front perspective view from below the device.

FIG. 2 is another front perspective view of the device 100. The device 100 (e.g., the frame 102) may comprise a bar 144. As shown, the aperture 116 may suitable for receiving a finger of a user to press tape 106 extending from the tape roll 104 against the bar 144. The tape 106 may be pressed against the bar 144 to releasably affix the tape 106 to allow cutting the tape 106 against the cutting edge 136. The device 100 may comprise only one bar 144 (e.g., only one bar 144 below the aperture 116, only one bar 144 reachable by a finger via the aperture 116, only one bar 144 below the front portion 112.

Figure 6:
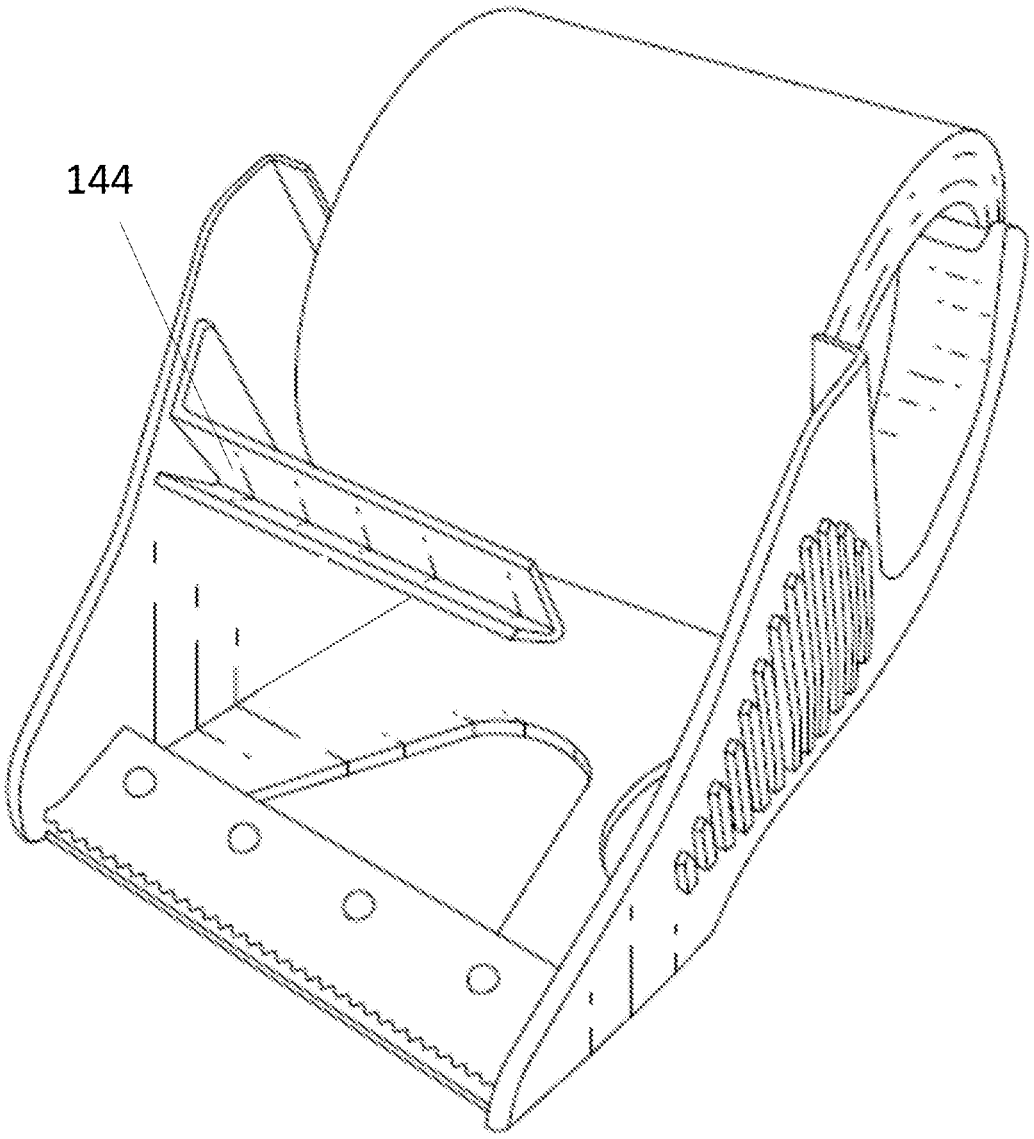
FIG. 6 shows a bottom perspective view of an example device showing a bar having an angled cross-section.

The bar 144 may at least partially extend (e.g., and may only partially extend) from one of the pair of side walls 138 towards the other of the pair of side walls 138. The bar 144 may comprise a side portion 146 adjacent the one side wall of the pair of side walls 138. The bar 144 may comprise a middle portion 148 extending from the side portion 146 towards the other of the pair of side walls 138. The length of the bar 144 may be less than a distance between the pair of side walls 138. The side portion 146 may be greater in length than the middle portion 148. The length may be in a lateral direction of the frame 102 from one of the pair of side walls 138 towards the other of the pair of side walls 138. The bar 144 may be located at or above a half-way point between a top of the one of the pair of side walls 138 and a bottom of the one of the pair of side walls 138. Bar configuration may include an angled or "V"-shaped cross-section, such as shown in FIG. 6, for example.

Figure 3:
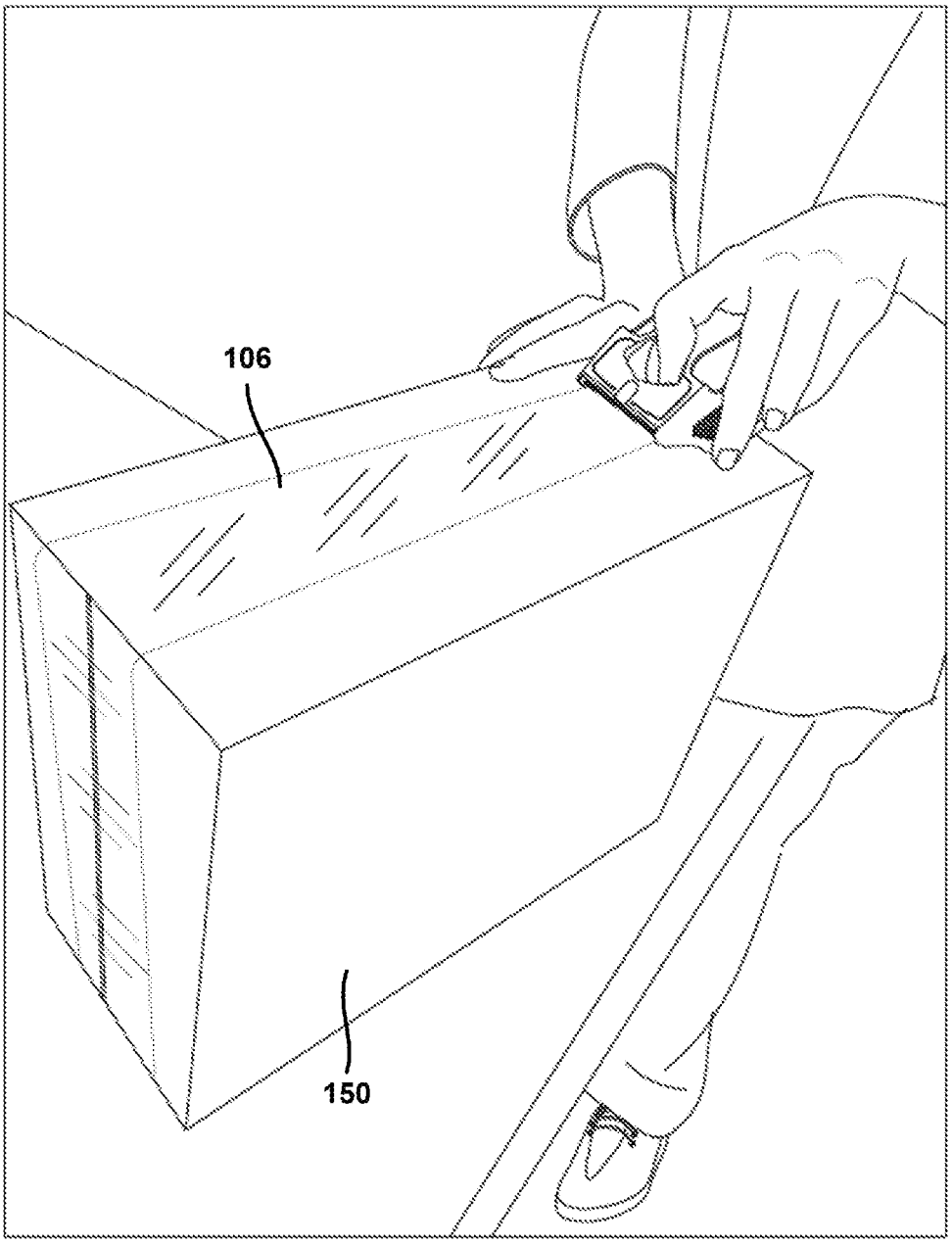
FIG. 3 is a perspective view of a user applying tape with the example device.
Figure 4:
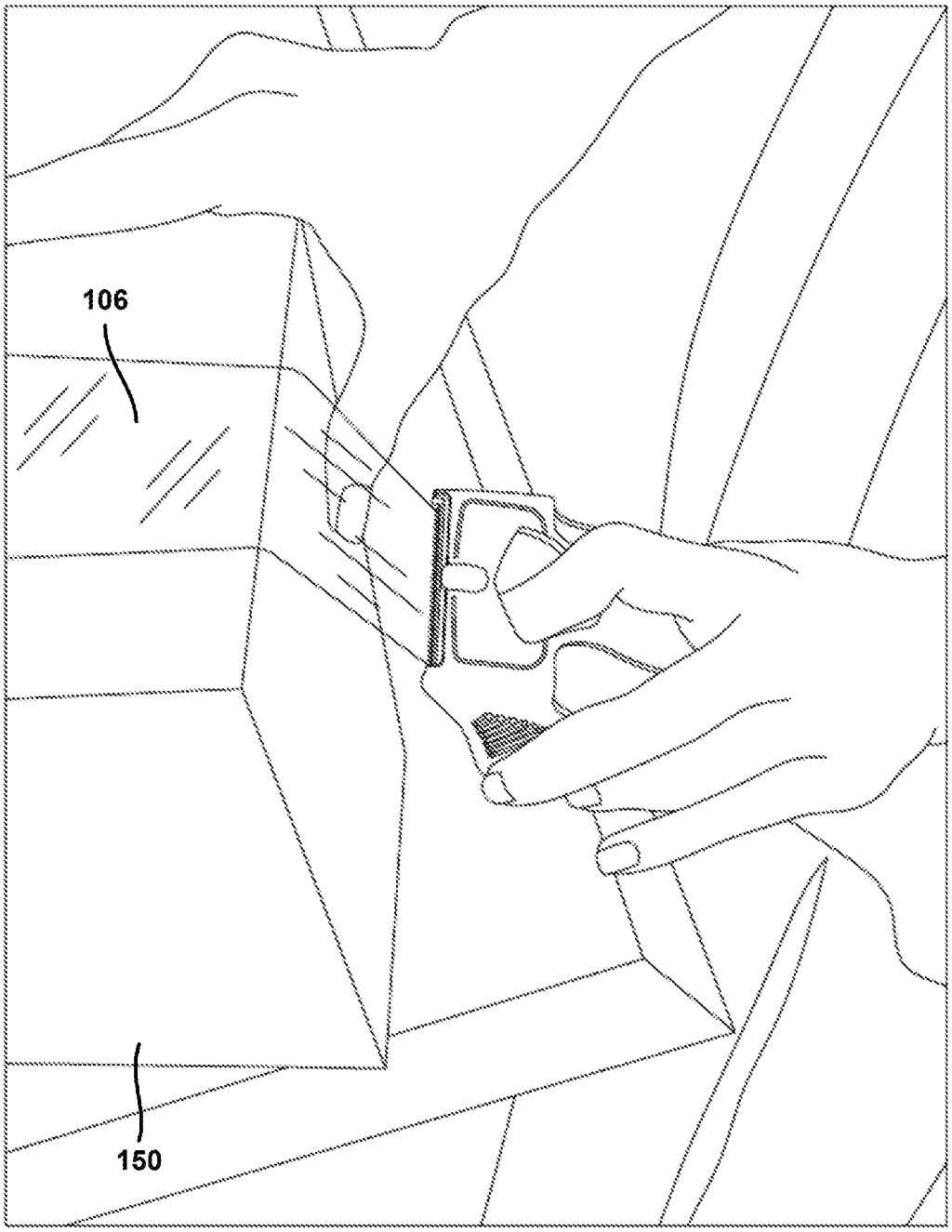
FIG. 4 is another perspective view showing application of the tape.

FIG. 3 is a perspective view of a user applying tape 106 with the example device 100. FIG. 4 is another perspective view showing application of the tape 106. The user may insert a tape roll 104 into a frame 102 of the device 100. The user may pull tape 106 from the tape roll 104. The tape 106 may be pulled in between the bar 144 and the tape guide portion 110. The user may affix an end of the tape 106 to a box 150. The user may pull the device 100 along a seam in the box 150 to tape two flaps of the box 150 together. The user may pull the device 100 along multiple sides of the box 150 to apply the tape 106 to the box 150.

As shown in FIG. 4, if a user is done applying the tape 106, the user may cut the tape 106 from the tape roll 104. The user may prevent unrolling of the tape roll 104 by forcing, via the aperture 116, at least a portion of the tape 106 against the bar 144. The user may insert a finger, such as a pointer finger, into the aperture 166. The user may press his or her finger on the tape 106 to force (e.g., push) the tape 106 against the bar 144. The user may move the device 100 in a manner to cause cutting of the tape 106 (e.g., while the user's finger is pressed against the tape 106 via the aperture 116) against the cutting edge 136. The user may cut an end of the tape 106 from the tape roll 104 while the tape roll 104 is prevented from unrolling.

Figure 5:
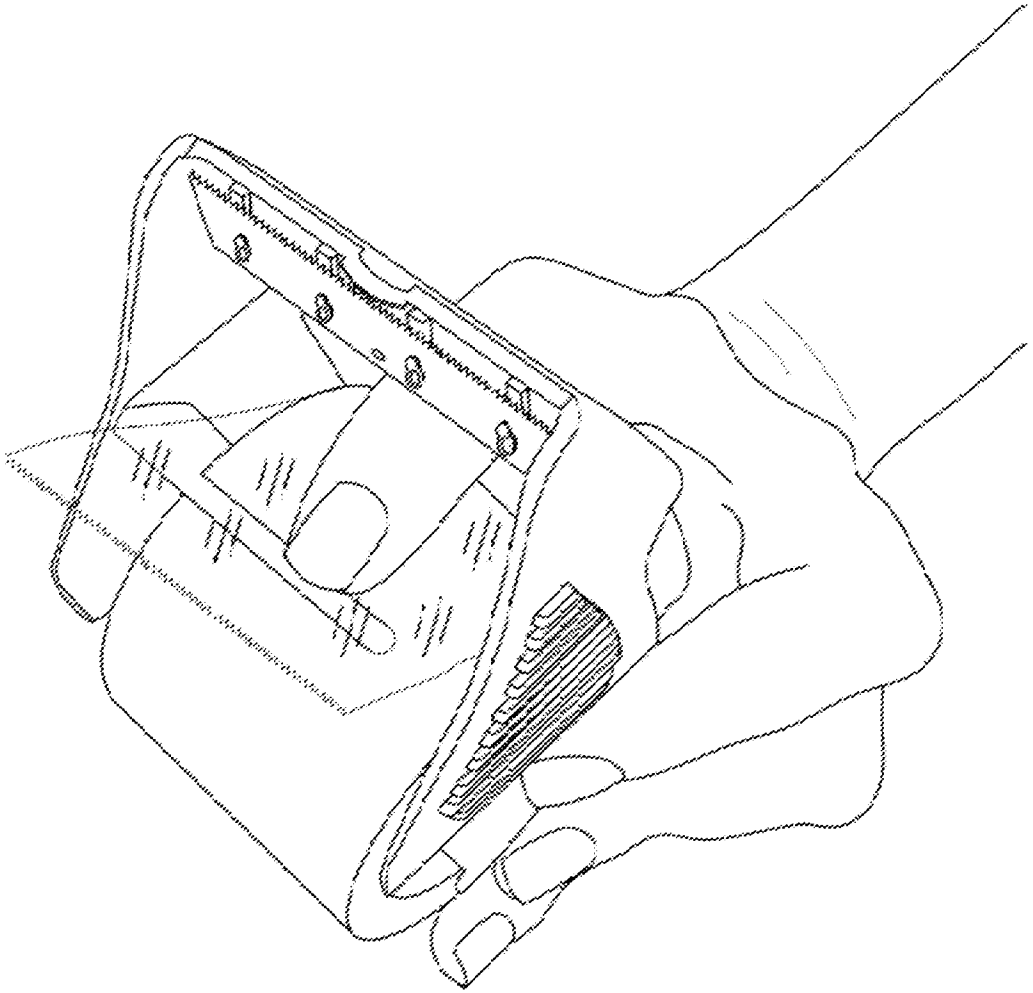
FIG. 5 is another front perspective view from below the device.

FIG. 5 is another front perspective view of the device 100 from below the device 100. After a user has cut the tape 106 from the tape roll 104, the user may continue to rest his or her finger on the bar 144. The bar 144 may also function as a resting place for the tape 106 to prevent the tape from reaffixing to the tape roll 104.

It is to be understood that the methods and systems are not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Components are described that may be used to perform the described methods and systems. When combinations, subsets, interactions, groups, etc., of these components are described, it is understood that while specific references to each of the various individual and collective combinations and permutations of these may not be explicitly described, each is specifically contemplated and described herein, for all methods and systems. This applies to all aspects of this application including, but not limited to, operations in described methods. Thus, if there are a variety of additional operations that may be performed it is understood that each of these additional operations may be performed with any specific embodiment or combination of embodiments of the described methods.

The various features and processes described above may be used independently of one another, or may be combined in various ways. All possible combinations and sub-combinations are intended to fall within the scope of this disclosure. In addition, certain methods or process blocks may be omitted in some implementations. The methods and processes described herein are also not limited to any particular sequence, and the blocks or states relating thereto may be performed in other sequences that are appropriate. For example, described blocks or states may be performed in an order other than that specifically described, or multiple blocks or states may be combined in a single block or state. The example blocks or states may be performed in serial, in parallel, or in some other manner. Blocks or states may be added to or removed from the described example embodiments. The example systems and components described herein may be configured differently than described. For example, elements may be added to, removed from, or rearranged compared to the described example embodiments.

While the methods and systems have been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its operations be performed in a specific order. Accordingly, where a method claim does not actually recite an order to be followed by its operations or it is not otherwise specifically stated in the claims or descriptions that the operations are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of embodiments described in the specification.

It will be apparent to those skilled in the art that various modifications and variations may be made without departing from the scope or spirit of the present disclosure. Other embodiments will be apparent to those skilled in the art from consideration of the specification and practices described herein. It is intended that the specification and example figures be considered as exemplary only, with a true scope and spirit being indicated by the following claims.

What is claimed:

1. A roll tape dispenser comprising:

a tape guide portion of a molded frame, the tape guide portion comprising a front portion and a back portion, the back portion extending rearward from the front portion to partially cover a tape roll;

a pair of side walls extending longitudinally rearward from the tape guide portion, each side wall of the pair of side walls comprising a top portion and a bottom portion, the bottom portion extending downward from the top portion to partially cover the tape roll;

a cutting edge disposed adjacent the front portion and the top portion, wherein the cutting edge is spaced from the tape roll for cutting at least a portion of the tape roll;

a pair of hubs for supporting the tape roll, each of the pair of hubs transversely extending inwardly from a corresponding side wall of the pair of side walls;

a bar that at least partially extends from one of the pair of side walls towards the other of the pair of side walls, wherein the bar is located at a half-way point between a top of the one of the pair of side walls and a bottom of the one of the pair of side walls and the bar includes a "V" shaped cross section; and an aperture disposed through the tape guide portion to define a through hole from a top side to a bottom side of the tape guide portion suitable for receiving a finger of a user to press tape extending from the tape roll against the bar to releasably affix the tape to the bar to prevent the tape roll from rotating while cutting the tape against the cutting edge.

2. The dispenser of claim 1, wherein at least a portion of the aperture tapers inwardly as the aperture extends from the front portion to the back portion of the tape guide portion.

3. The dispenser of claim 1, wherein the aperture comprises a font side towards the front portion and a back side towards the back portion, and wherein the aperture comprises a right side and a left side opposite the right side and extending between the front side and the back side, wherein the back side is curved between the left side and the right side.

4. The dispenser of claim 3, wherein the front side is angled and includes a vertex, and wherein a front left side extends from the vertex to the left side of the aperture, and wherein a front right side extends from the vertex to the right side of the aperture.

5. The dispenser of claim 1, wherein the aperture has a shape of a diamond, circle, or ellipse.

6. The dispenser of claim 1, wherein the bar comprises a side portion adjacent the one side wall and a middle portion extending from the side portion towards the other of the pair of side walls, wherein the side portion is greater in length than the middle portion.

7. The dispenser of claim 1, wherein the cutting edge comprises a razor attached to the front portion of the tape guide portion.

8. The dispenser of claim 1, wherein each of the pair of hubs has a curved top side.

9. The dispenser of claim 1, further comprising a plurality of ridges on an outer surface of the pair of side walls.

10. The dispenser of claim 1, wherein the back portion of the tape guide portion is at least partially curved inwardly.

11. A roll tape dispenser comprising:

a tape guide portion;

a pair of side walls extending longitudinally rearward from the tape guide portion, each side wall of the pair of side walls comprising a top portion and a bottom portion, the bottom portion extending downward from the top portion to partially cover the tape roll;

a cutting edge disposed adjacent the front portion and the top portion, wherein the cutting edge is spaced from the tape roll for cutting at least a portion of the tape roll;

a bar that at least partially extends from one of the pair of side walls towards the other of the pair of side walls, wherein the bar is located at a half-way point between a top of the one of the pair of side walls and a bottom of the one of the pair of side walls and the bar includes a "V" shaped cross section; and an aperture disposed through the tape guide portion to define a through hole from a top side to a bottom side of the tape guide portion for receiving a finger of a user to press tape extending from a tape roll against the bar to releasably affix the tape to the bar to prevent the tape roll from rotating while cutting the tape.

12. The dispenser of claim 11, wherein at least a portion of the aperture tapers inwardly as the aperture extends from a front portion of the tape guide portion to a back portion of the tape guide portion.

13. The dispenser of claim 11, wherein the aperture comprises a font side towards a front portion of the tape guide portion and a back side towards a back portion of the tape guide portion, and wherein the aperture comprises a right side and a left side opposite the right side and extending between the front side and the back side, wherein the back side is curved between the left side and the right side.

14. The dispenser of claim 13, wherein the front side is angled and includes a vertex, and wherein a front left side extends from the vertex to the left side of the aperture, and wherein a front right side extends from the vertex to the right side of the aperture.

15. The dispenser of claim 11, wherein the aperture has a shape of a diamond, circle, or ellipse.

16. The dispenser of claim 11, wherein the bar comprises a side portion adjacent the one side wall and a middle portion extending from the side portion towards the other of the pair of side walls, wherein the side portion is greater in length than the middle portion.

17. The dispenser of claim 11, further comprising a pair of hubs for supporting the tape roll, each of the pair of hubs transversely extending inwardly from a corresponding side wall of the pair of side walls.

18. A method comprising:

inserting a tape roll into a molded frame comprising:

a tape guide portion, a pair of side walls extending longitudinally rearward from the tape guide portion, each side wall of the pair of side walls comprising a top portion and a bottom portion, the bottom portion extending downward from the top portion to partially cover the tape roll, a cutting edge disposed adjacent the front portion and the top portion, wherein the cutting edge is spaced from the tape roll for cutting at least a portion of the tape roll, a bar that at least partially extends from one of the pair of side walls towards the other of the pair of side walls, wherein the bar is located at a half-way point between a top of the one of the pair of side walls and a bottom of the one of the pair of side walls and the bar includes a "V" shaped cross section, and an aperture disposed through the tape guide portion to define a through hole from a top side to a bottom side of the tape guide portion;

pulling tape from the tape roll;

preventing unrolling of the tape roll by forcing, via the aperture, at least a portion of the tape against the bar to releasably affix the tape to the bar; and cutting an end of the tape from the tape roll while the tape is affixed to the bar.

* * * * *